United States Patent [19]

Carlson

[11] 4,019,417

[45] Apr. 26, 1977

[54] ELECTRICAL MUSICAL INSTRUMENT WITH CHORD GENERATION

[75] Inventor: Alden J. Carlson, Edmonds, Wash.

[73] Assignee: Warwick Electronics Inc., Chicago, Ill.

[22] Filed: June 24, 1974

[21] Appl. No.: 482,064

[52] U.S. Cl. ..... 84/1.01; 84/1.03; 84/1.17; 84/DIG. 22

[51] Int. Cl.[2] ..... G10H 1/00

[58] Field of Search ..... 84/1.01, 1.03, 1.17, 84/DIG. 22, 1.19, 1.04, DIG. 2

[56] References Cited

UNITED STATES PATENTS

| | | | |
|---|---|---|---|
| 2,874,286 | 2/1959 | Bode | 84/DIG. 2 |
| 3,546,355 | 12/1970 | Maynard | 84/1.03 |
| 3,548,066 | 12/1970 | Freeman | 84/1.17 X |
| 3,549,776 | 12/1970 | Shiga et al. | 84/1.03 |
| 3,567,838 | 3/1971 | Tennes et al. | 84/1.17 X |
| 3,659,031 | 4/1972 | Adachi | 84/1.01 |
| 3,719,767 | 3/1973 | Matumoto et al. | 84/1.01 |
| 3,789,718 | 2/1974 | Bunger | 84/1.01 |
| 3,836,692 | 9/1974 | Nakajima | 84/1.17 X |
| 3,844,192 | 10/1974 | Brand et al. | 84/DIG. 22 |
| 3,889,568 | 6/1975 | Amaya | 84/1.03 |

*Primary Examiner*—Ulysses Weldon
*Attorney, Agent, or Firm*—Wegner, Stellman, McCord, Wiles & Wood

[57] ABSTRACT

An electronic organ includes logic and a memory for detecting and storing a root note signal identifying a chord which has been either automatically or manually generated. Priority logic, coupled with the memory, passes the lowest root note signal to a tone selection matrix which passes a plurality of tone signals representing the note intervals forming the selected chord. A sequential gating circuit receives all of the tone signals and is responsive to an arpeggio circuit, a strum circuit, or a rhythm unit to gate selected tone signals, one at a time, to the voicing circuitry. When one or more of the tone signals are octavely displaced within the selected chord, disinverting gates are enabled to unfold the chord and cause the tone signals to occur in order of ascending frequency.

8 Claims, 4 Drawing Figures

FROM 46
G
G#
A
A#
B
C
C#
D
D#
E
F
F#
42
ROOT
50
58
312
310
314
52
84
FLATTED
THIRDS
286
292
THIRDS
54
88
86
FIFTH
56
296
THIRD
GATES
44
284
THIRD
GATES
290
FLATTED
272
274
276
270
280
294

ELECTRICAL MUSICAL INSTRUMENT WITH CHORD GENERATION

BACKGROUND OF THE INVENTION

This invention relates to an electrical musical instrument having digital circuitry for producing chordally related tones.

Electronic organs have included circuitry for automatic chord selection and generation of chordally related tone signals. However, use of the chlordal tone signals has generally been limited to the audio reproduction thereof. Circuitry for controlling automatic sequential tone generation has been separate from the chordal circuitry, since the function of sequential tone generation has been considered a separate feature functionally unrelated to the chord feature of the electronic organ.

Digital circuitry for producing a sequential series of related tones is known. An accompaniment melody can be played on the lower manual of an electronic organ by manual selection of keys, or by selection of automatic accompaniment circuitry. For example, it is known to provide sequentially enabled gates controlled by an arpeggio circuit or by a strum circuit. It also is known to play, one at a time and in a rhythmic fashion, several related notes associated with selected keys. In an organ effect known as "counter melody", chordally related tones are sequentially played in a rhythmic fashion, with an equal or unequal time interval between tones, in order to simulate various types of melody which can be played on the lower keyboard.

Automatic chord selection in electronic organs has been limited to generation of the root, third, fifth and other standard interval notes. However, a player may manually generate other types of chords such as an inverted chord in which one or more of the notes forming the chord may be octavely displaced with respect to the standard root note. For example, the third interval note may be played in a higher octave than the root note and the fifth note. While electronic organs have allowed an operator to manually generate any type of chord, prior automatic circuits have not allowed processing of complex tone signals such as occur in inverted chords or the like.

SUMMARY OF THE INVENTION

In accordance with the present invention, an improved musical instrument includes digital circuitry for producing a variety of musical effects concerning chordally related tones. The chordal generation circuitry is upstream from sequential gating circuitry such as is provided for arpeggio, strum, counter melody and the like features, in order to allow a great variety of special musical effects to be accomplished by sequential gating from among a large number of simultaneously generated tone signals. A priority logic circuit, coupled to a chord memory, selects the chord having the lowest root tone.

Some of the chordally related tones may form an inverted chord, which is unfolded by disinverting gates to produce a chord having intervals in ascending frequency.

The digital circuitry for accomplishing the above is readily adpated to integrated circuit techniques, and can be incorporated in a single large integrated circuit chip. By appropriate interconnections of input and output lines, additional features may be added, as desired, to the electronic organ. Thus, the digital circuitry is of a general or universal nature, and many musical effects may be accomplished due to the availability of simultaneously generated tone signals, which may be sequentially gated as desired.

One object of the present invention is the provision in an electrical musical instrument of improved chord generation circuitry for simultaneously generating a plurality of chordally related tone signals which are coupled to a sequential gating circuit for individual coupling to voicing circutry, under control of various circuits for producing accompaniment effects such as arpeggio or counter melody.

Another object of the present invention is the provision of improved chordal circuitry for processing chordally related tones which may represent an inverted chord.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

GENERAL OPERATION

Figure 1A:
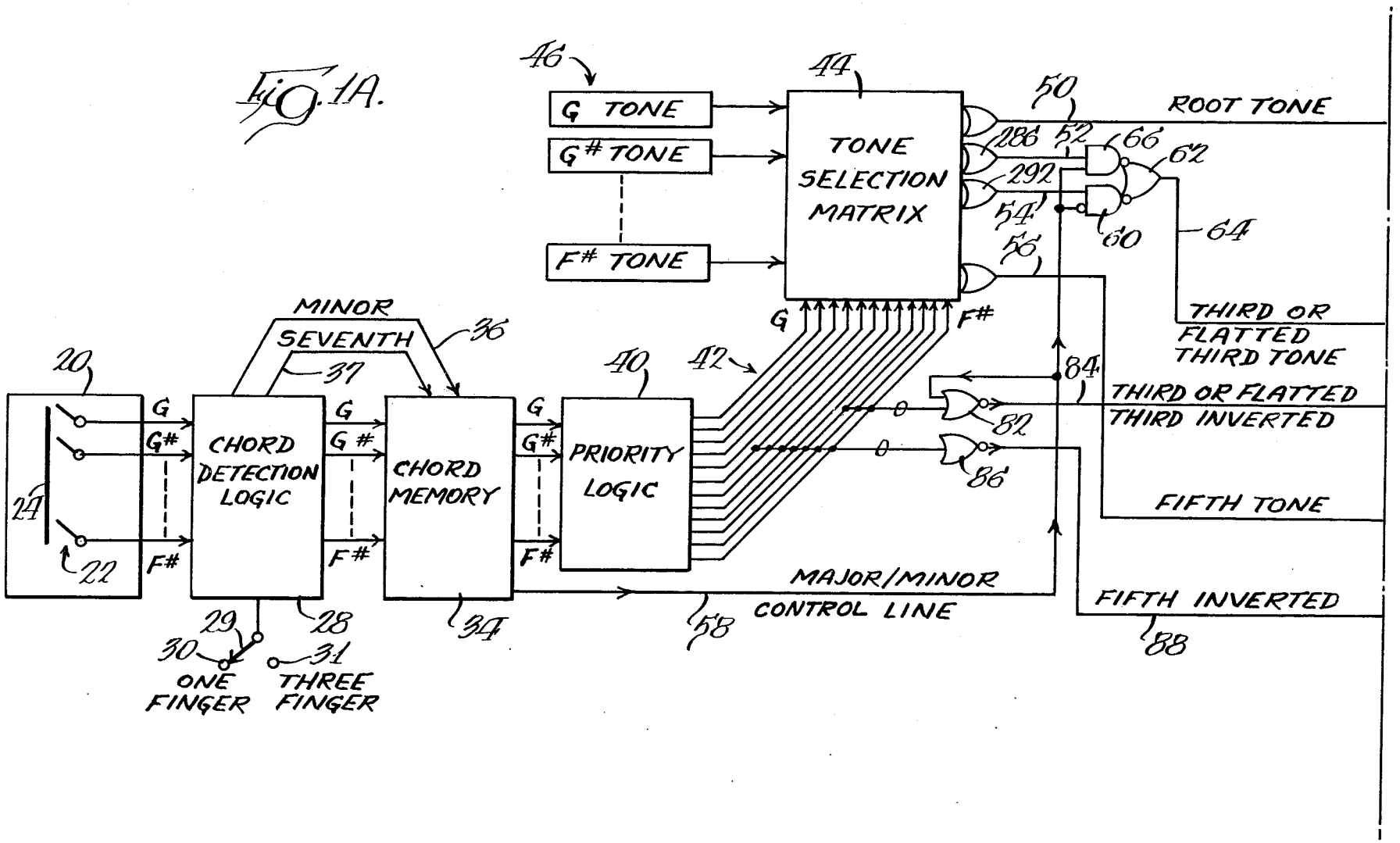
FIGS. 1A and 1B form a single partly block and partly schematic diagram of an electronic organ having digital circuitry for chord selection and sequential gating.
Figure 1B:
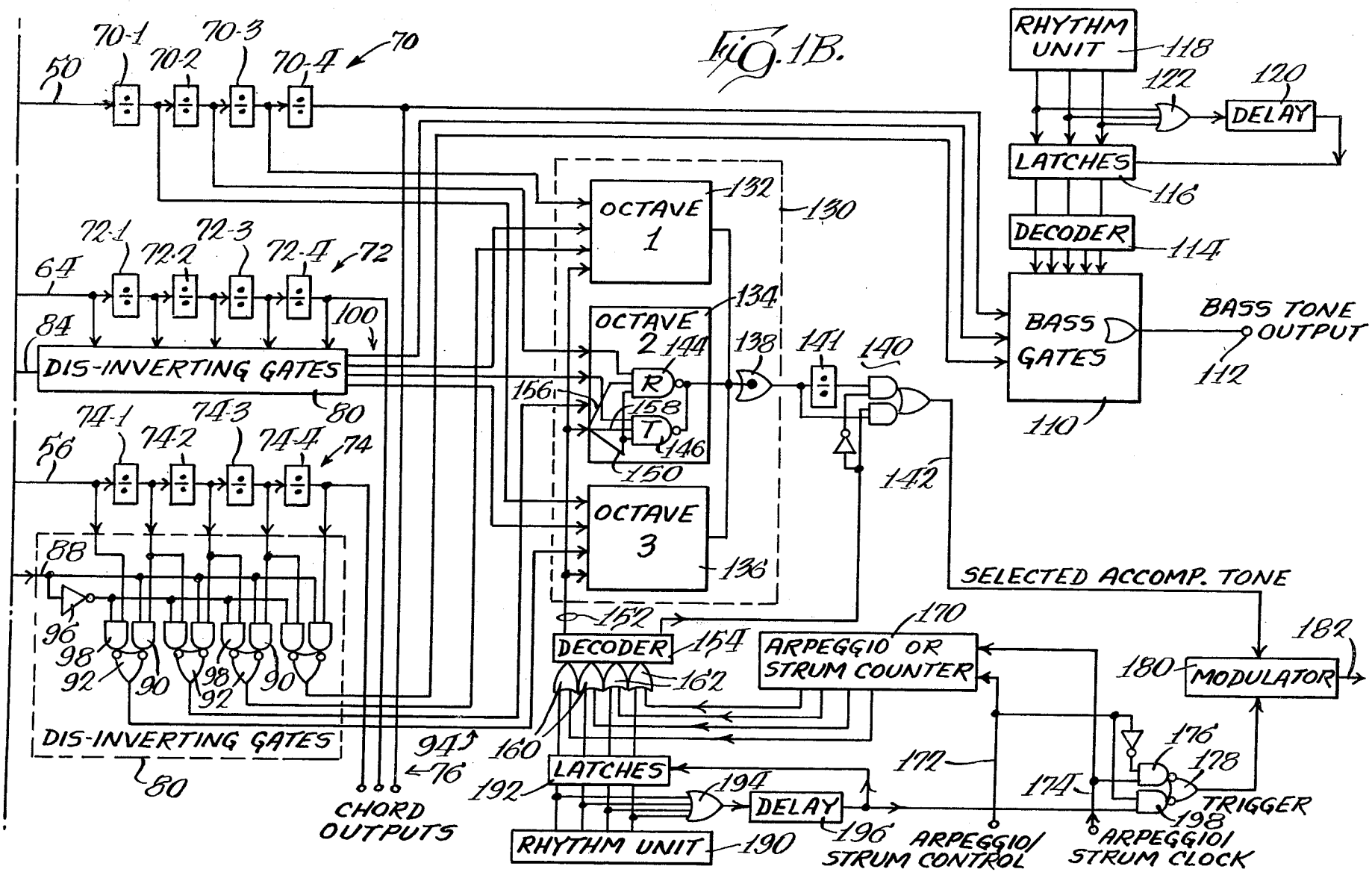

FIGS. 1A and 1B form a single diagram which may be connected together by superimposing the dashed lines shown on the right hand side of FIG. 1A, with the dashed lines shown on the left hand side of FIG. 1B. The FIG. 1 diagram shows only the accompaniment portion of an electronic organ or other keyboard electrical musical instrument, and conventional circuitry may be provided for the solo or upper manual portion of the electronic organ, as well as for other conventional portions of the electronic organ.

Referring to FIG. 1A, a chord selector 20 includes a number of chord switches 22 each associated with a different note on the lower manual of the organ. All octavely related notes are coupled to the same chord switch 22 so that, for example, depression of any of the G note key switches (not shown) on the lower manual causes the uppermost G chord switch 22 to be closed against a member 24 which carries a control voltage thereon. For clarity, only three chord output lines G, G#, and F# are illustrated of the twelve chord output lines which are provided. If the player depresses several accompaniment key switches at the same time, as for example C, E, G (representing a C major chord), the three chord switches 22 corresponding to C, E and G will be closed against member 24, and all three output lines will pass control voltages to a chord detection logic circuit 28.

The chord detection logic 28 include a chord mode switch 29 which is movable to a terminal 30, to select a single finger chord operation, or to a terminal 31, to select a three finger chord operation. Logic 28 detects or identifies the chord being played, and generates a single output signal identifying the root note of the detected chord. The root note signal is passed to a chord memory 34 which includes a separate latching circuit or memory for each of the 12 root notes which can form a chord. In addition, chord detection logic 28 determines whether the selected chord is a minor chord rather than a major chord, generating on a minor chord line 36 a minor chord signal which causes a minor chord latch within memory 34 to be enabled.

Chord detection logic 28 may include additional selection circuits for expanding upon the basic three note chord output which, for clarity, has been illustrated. For example, when in the single finger mode, logic 28 may generate, in addition to the root, third and fifth tones, a sixth tone, and a flatted seventh tone on a seventh line 37, for enabling an appropriate latch in memory 34. Similar provisions may be made for selecting other note intervals in accordance with the type of chord which is to be generated.

In the illustrated electronic organ, the lower notes and lower note chords are to be favored. For this reason, priority logic 40 is located between the output of the chord memory 34 and a plurality of desired chord output lines 42. If the operator has selected the one finger mode, and depresses an E key, the E latch in memory 34 will be enabled and the priority logic 40 will enable the corresponding E chord line 42. Should the operator then depress the C key, while still depressing the E key, the C latch in memory 34 will be set in addition to the E latch. The priority logic 40 is now responsive to switch the single output signal on lines 42 from the E line to the C line. It will be appreciated that this feature is of advantage to novice players who do not have the dexterity to select chords in an optimum manner. Thus, the chord output lines 42 carry only a single signal, representative of the root note of the lowest detected chord.

The chord output signal enters a tone selection matrix 44 which also has inputs from twelve tone generators 46. For reasons to be discussed later, the lowest frequency tone from the generators is selected as G, rather than C. Therefore, the first five notes G through B from the tone generators 46 fall in one octave, and the remaining seven notes C through F# fall in the next higher octave. Since the accompaniment tones are generated by dividing the tone signals from the tone generators 46, the frequencies of the generators 46 are preset to correspond to the highest accompaniment frequencies generated by the organ. In response to the single enabled chord output line 42, matrix 44 gates the tone signals forming that chord to a root tone output line 50, a flatted third tone line 52, a third tone line 54, and a fifth tone output line 56.

For example, if the C chord line 42 was enabled, matrix 44 would pass a C tone signal to the root tone output line 50, a D# tone signal to line 52, an E tone signal to line 54, and a G tone signal to the fifth tone output line 56. A major/minor control line 58 from chord memory 34 carries a signal to NAND gates 60 and 66 indicating whether a major chord or a minor chord has been detected. When a major chord is detected, as indicated by a logical 0 on line 58, NAND gate 60 having an inverting input connected to line 58; is enabled in order to pass the third tone on line 54 to an OR gate 62 which passes the selected third interval to an output line 64. In the case of selection of a C major chord, the E tone signal on line 54 is passed to output line 64. Alternatively, if control line 58 indicates by a logical 1 that a minor chord has been detected, the NAND gate 60 is disabled and NAND gate 66 is enabled, passing the flatted third tone through the OR gate 62 to the third interval output line 64. In the case of a C minor chord, this allows the D tone signal on line 52 to be gated to line 64. While output note signals are generated for the root, third, and fifth interval tones, the matrix 44 may generate additional interval tones, as for the sixth tone and the seventh tone.

Turning to FIG. 1B, the interval related tone signals on lines 50, 64 and 56 are coupled to separate frequency dividers for producing four octave output signals for each tone signal. Four series dividers 70, labeled 70-1 through 70-4, each divides-by-two the root tone signal to provide four octave outputs of descending frequencies. Similarly, four series dividers 72, labeled 72-1 through 72-4, are provided for the third or flatted third tone signal, and four series dividers 74, labeled 74-1 through 74-4, are provided for the fifth tone signal. Since each divider divides the frequency by two, the output of each divider corresponds to one octave decrease. All outputs of the last dividers are connected directly to chord output lines 76, to provide the lowest octave tone signals corresponding to the detected chord.

The outputs of the third tone dividers 72 and the fifth tone dividers 74 are coupled to disinverting gates 80 which unfold the chord, when inverted, so that the root, third and fifth tone signals are provided in order of ascending frequency. A third or flatted third inverted detection circuit 82, see FIG. 1A, generates a control signal on a control line 84 when the third or flatted third tone signal of the selected chord is inverted. Similarly, a fifth inverted detection circuit 86 generates a control signal on a control line 88 when the fifth tone signal of the selected chord is inverted. The output signals on control lines 84 and 88 cause the disinverting gates 80, FIG. 1B, to shift all output tones by one octave, thereby unfolding the chord.

In the illustrated electronic organ, unfolding is necessary because the lowest frequency tone generator 46, FIG. 1A, corresponds to the G tone signal, rather than the C tone signal. Therefore, certaifn chords will always be inverted unless the third and fifth tone signals are shifted by one octave. The G tone signal is selected as the lowest frequency to implement a learning method for beginning players, in which certain keys of the keyboard are color coded to teach fundamentals about organ playing. To simplify the learning process, the color coded keys fall in two adjacent octaves, resulting in the tone generators 46 covering two octaves. When utilizing the automatic feature of "counter melody", which is discussed later, the individual chord notes are played rhythmically one at a time in several octaves. It is therefore necessary to have the chord tones in ascending frequency so that the tones do not fold back when stepping through the octaves. The purpose of the disinverting gates 80 is thus to produce a noninverted chord in response to detection of any major or minor chord.

However, it will be appreciated that the disinverting gates 80 can also disinvert a selected inverted chord. An inverted chord may be selected by the player, by depression of appropriate key switches, or by a modified logic circuit 28, FIG. 1A, in which selection of a one finger mode, and an added inverted chord mode, would produce from matrix 44 a series of tone signals representing an inverted chord rather than a normal chord. The inverted detection circuits 82 and 86 would be interconnected in a manner to indicate logically the presence of such an inverted chord, producing corresponding output signals on inverted control lines 84 and 88 to cause unfolding of the chord when a normal chord output was desired. Either use of the disinverting gates 80 is contemplated by the present invention.

Each disinverting gate 80 is comprised of the circuit illustrated by the lowermost gate 80, associated with the fifth tone. The control line 88 is coupled directly to NAND gates 90 of each three gate combination. Each NAND gate 90 has its other input coupled to a corresponding output of different ones of the dividers 74. When the chord is not inverted, all NAND gates 90 are enabled to cause the divider outputs to pass through the NAND gates 90, and the associated OR gates 92, to output lines 94.

When the chord is inverted, however, the control signal on line 88 blocks NAND gates 90. Due to a NOT gate 96, the control signal now enables a plurality of NAND gates 98, located on the left in each three gate grouping. Each NAND gate 98 has its other input coupled to the inputs to the dividers. When all NAND gates 98 are enabled, the output lines 94 carry signals which are all increased in frequency by one octave, since the output OR gates 92 are coupled prior to the dividers, rather than after the dividers. Thus, the four outputs from the disinverting gates are shifted upward in frequency by one octave when the chord is inverted.

The two lowest octave outputs associated with the root tone, the lowest octave third or flatted third tone (unfolded if necessary), and the lowest octave fifth tone (unfolded if necessary), are coupled to conventional bass gates 110 for selection of the bass melody tone. The output line 112 is coupled to the pedal divider and keyer. To create a walking bass tone output, rhythm may be applied to the bass notes by a decoder 114 which activates selected ones of the bass gates in accordance with the output from a plurality of latches 116. The latches 116 are binary memories set under control of a rhythm unit 118 which generates a sequential series of binary words representing the gating to be applied to the 16-foot output tone signals. The latches 116 are reset under control of a delay unit 120 which receives an input from an OR gate 122, connected to the binary word output of the rhythm unit 118. Thus, each new binary word generated by the rhythm unit 118 sets the latches 116 after a predetermined time period which is controlled by delay unit 120 to create a walking base output.

The higher octave ouputs of the disinverting gates and the root dividers are coupled to a sequential gating matrix 130 which provides accompaniment melody tone selection or "counter melody". The respective octave outputs are coupled to Octave 1 gates 132, Octave 2 gates 134, and Octave 3 gates 136. A master OR gate 138 passes the gated accompaniment tone signals to a selectable octave lowering circuit 140.

Each Octave gate 132, 134, and 136 includes at least one NAND gate, as is partially illustrated for the Octave 2 gate 134. A root (R) NAND gate 144 has one input coupled to an associated root divider 70. A third (T) NAND gate 146 has an input from the disinverting gates 80 associated with the third tone dividers 72. Finally, a fifth (F) NAND gate (not illustrated) has an input from the disinverting gates 80 associated with the fifth tone dividers 74. All NAND gates R, T and F within the Octave gate also have a common octave input line 150, which is a part of a decoder cable 152 from a decoder 154. Finally, each NAND gate R, T and F within the Octave gate has a separate input for selecting only that gate, such as R line 156 for the R NAND gate 144 and a T line 158 for the T NAND gate 146, which lines form a portion of the cable 152.

Decoder 154 includes an octave decoder and a tone decoder, each being responsive to a two-bit binary word to energize an appropriate single output line. Three of the four output lines from the octave decoder are individually coupled to the octave lines 150 in each Octave gate. The fourth ouput line is coupled to the octave lowering circuit 140, to enable the AND gate which inserts the illustrated divider 141 in circuit with an output line 142, and thereby lower the output by one octave. The note decoder has three outputs R, T and F corresponding to the tones available from each Octave gate. Thus, the R output is coupled to each R input line 156, and the T output is coupled to each T input line 158.

A pair of OR gates 160 input the two-bit binary word which controls the octave decoder, and a pair of OR gates 162 input the two-bit binary word which controls the tone decoder. By appropriate choice of the four-bit word coupled to OR gates 160 and 162, any single NAND gate within the matrix 130 can be individually actuated to pass the tone signal coupled thereto to the master OR gate 138. Each different four-bit binary word thus selects a different single NAND gate, and a series of binary words thereby sequentially selects the NAND gates so as to produce a sequential series of tone signals.

One set of inputs to OR gates 160 and 162 are coupled to an arpeggio or strum counter 170, controlled by a three signal level arpeggio/strum control input 172, and by an arpeggio/strum clock input 174. When the level on control input 172 enables the arpeggio mode of counter 170, the clock pulses on the arpeggio/strum clock input 174 at the frequency of the external arpeggio/strum clock step the counter 170 to thereby sequentially generate different binary words to initially actuate each NAND gate within the Octave 1 gate, followed by each NAND gate in the Octave 2 gate, and so forth. This produces an arpeggio effect in the output of the organ. The control input 172 also enables, at this time, a NAND gate 176 to pass the clock pulses on line 174 to an OR gate 178 in order to generate trigger pulses for a modulator 180. The modulator 180 also has as an input from the output line 142 of the matrix 130, producing on an output line 182 an accompaniment melody which is coupled to conventional voicing circuitry for the accompaniment channel. When control input 172 disables counter 170, the NAND gate 176 is blocked.

Control input 172 can also activate counter 170 in the strum mode. This causes binary words to be generated which step only the note decoder to cyclically enable only the NAND gates in the Octave 1 gate, creating a strum effect.

Sequential enabling of matrix 130 may also be controlled by a rhythm unit 190, associated with bass rhythm unit 118, when the level of control line 172 disables the counter 170. The rhythm unit 190 can also generate four-bit binary words to control selection of individual NAND gates within matrix 130, in order to create a "counter melody" effect. The four-bit words from rhythm unit 190 are stored in latches 192, which have outputs coupled to the OR gates 160 and 162. The presence of a new four-bit word is detected by an OR gate 194, to trigger a delay line 196 in order to reset the latches 192 after lapse of a predetermined time delay. The output of delay line 196 is also passed to NAND gate 198, for passing the clock pulses on input 174 to the trigger input of modulator 180.

When rhythm unit 190 is enabled, melody is played in the octaves of the lower manual in a "counter melody" manner. That is, notes which are selected by constant depression of the keys of the lower manual are played, one at a time, in a modulated rhythmic fashion. The notes are not necessarily played in the selected octave, but also are played in other octaves. In terms of actual musical effect, the counter melody feature sounds like a melody played on the lower keyboard and consisting of three notes. The spacing between notes is not necessarily constant, but may be varied as controlled by the timing between the four-bit words generated by the rhythm unit 190.

Sequential gating matrix 130 and associated decoder 154 may be similar to the digital circuit disclosed in a copending application, Ser. No. 418,577 of Roman A. Adams, filed Nov. 23, 1973, entitled "Electrical Musical Instrument with Automatic Sequential Tone Generation", and assigned to the assignee of the present application. For example, the Adams application shows separate octave and note decoders, such as utilized in decoder 154 herein, and separate octave and note counters, such as corresponds to counter 170 herein, in order to sequentially enable a series of AND gates for generating a sequential series of tones. Thus, the circuit in the Adams application can be adapted for use in the present system, if desired, and reference should be made to said copending application for an example of the details of such a circuit.

CHORD AND PRIORITY CIRCUIT

Figure 2:
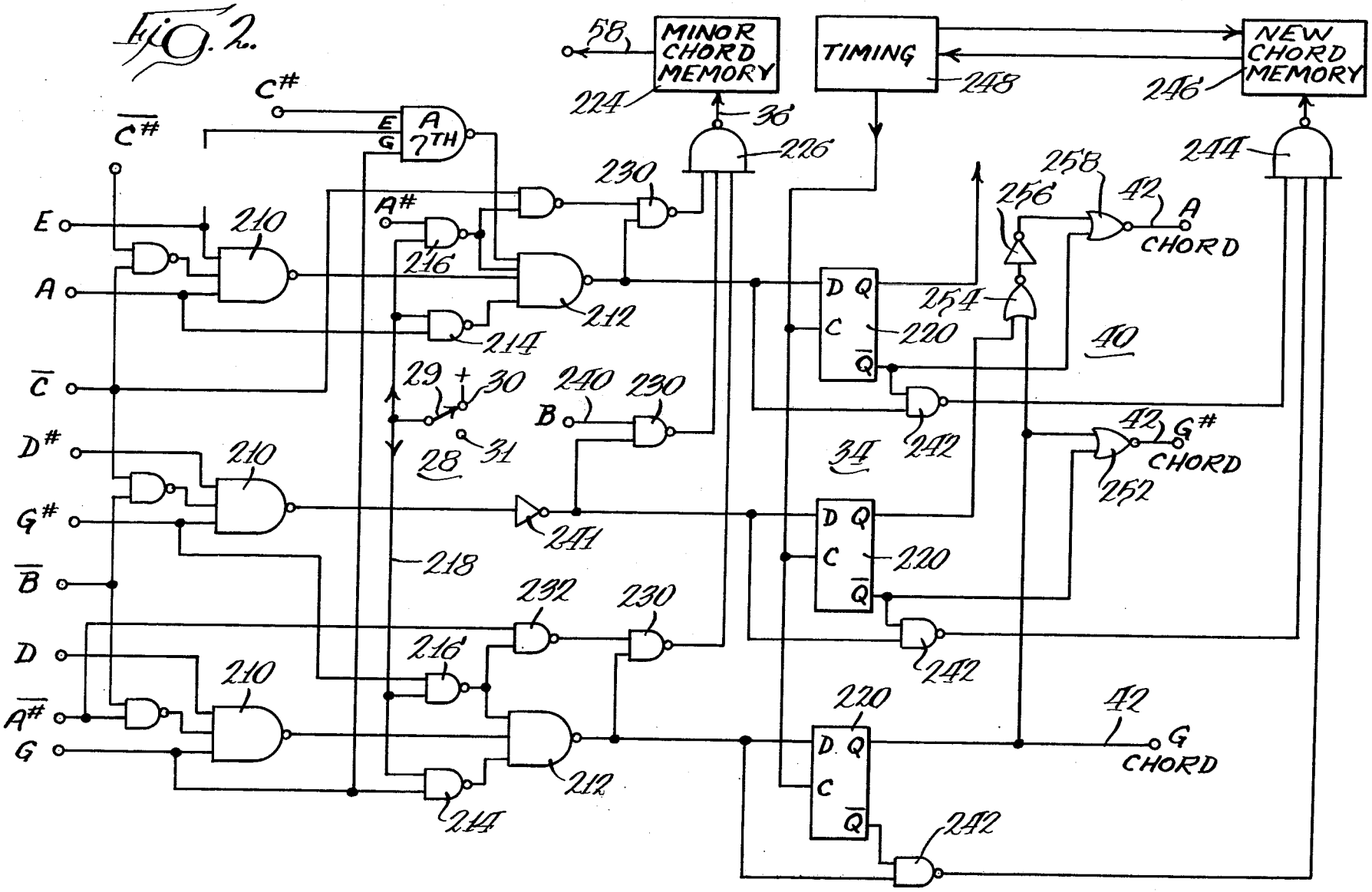
FIG. 2 is a schematic diagram of the chord detection logic, chord memory, and priority logic circuits shown in block form in FIG. 1A.

In FIG. 2, chord detection logic 28, chord memory 34, and priority logic 40, shown in block form in FIG. 1A, are illustrated in detail. For simplification only the circuitry associated with the G chord, and G# chord and the A chord are illustrated in detail. It will be appreciated that similar circuitry is provided for the remaining nine chords. In FIG. 2, the input signals are from the chord switches 22, but for simplification, only the letter designation of the chord switch is indicated in FIG. 2. Components that perform similar operations, but for different chords, have been labeled with the same identifying number. The letter designation with a bar above them indicate absence of a signal input.

A plurality of NAND gates 210 provide three finger chord recognition. The inputs to each NAND gate 210 corresponds to chord switches representing the well-known notes, consisting of a root, a third or flatted third, and a fifth, representing the labeled chord. For example, the lowermost NAND gate 210 in FIG. 2 generates an output signal to a NAND gate 212 when the chord switches indicate the presence of a G note, a D note, and either an A# or a B note. The NAND gate 212 has an output when a three finger chord is recognized, or when a single finger chord is recognized, either by a single finger major chord NAND gate 214 or a single finger minor chord NAND gate 216. Both NAND gates 214 and 216 have a common input 218 coupled through mode selection switch 29 to a logic 1 source connected with terminal 30. When the player selects the single finger mode, by moving switch 29 to terminal 30, both NAND gates 214 and 216 are enabled for recognition of a single finger chord. The lowermost illustrated NAND gate 214 has its other input coupled to the G chord switch, so depression of the white G key will enable a G major chord representation (when switch 29 is on terminal 30). Conversely, if a minor chord has been selected by depression of the black G# key, then NAND gate 216 will enable a G minor chord representation by producing a signal to NAND gate 212 and NAND gate 232.

The output from NAND gate 212 sets a chord flip-flop or latch 220 in chord memory 34. In the three finger mode, each latch 220 is set only when the corresponding chord is recognized by its associated NAND gate 210. However, in the single finger mode, NAND gates 210 are bypassed and latch 220 receives an input from NAND gate 212 through NAND gates 214 or 216, depending on whether a major or minor chord is desired. Major chords are selected by white keys and minor chords by selection of the associated black key. Selection of a black G# key, for example, represents selection of a G minor chord and causes the lowermost latch 220 (associated with the G output) to be set, along with setting of a minor chord memory 224. The second next latch 220 (associated with the G # output) is not set during the single finger mode. In the single finger mode minor chord memory 224 is always set by selection of a black key and the associated major chord latch 220 is also set. Minor chord memory 224 is also set by selection of a three finger minor chord.

When a minor chord is selected, the minor chord memory 224 is enabled by a signal on line 36 which corresponds to the output of a NAND gate 226. The inputs to NAND gate 226 are from all of the minor chord recognition NAND gates 230. When for example the single finger mode is selected and the black G # key is depressed, NAND gate 212 has an output to one input of NAND gate 230. The other input to NAND gate 230 is enabled from the G # key through NAND gates 216 and 232. Thus, NAND gate 226 is enabled for recognition of a G minor chord and enables minor chord memory output line 58.

For use in the three finger mode, the minor chord recognition NAND gates 230 in the # chord channels receive inputs from the flatted third of the chord and from NAND gates 210 through a NOT gate 241. Thus NAND gates 230 and 212 logically recognize the associated minor chord. For examples, the G # minor chord, G # B D # , sets the G # major chord latch 220 and the minor chord memory 224 through NOT gate 241 and the associated NAND gate 230.

A plurality of NAND gates 242 determine when a new chord is being played. For each latch 220 which is not turned on, its $\overline{Q}$ output couples a "1" bit to the associated NAND gate 242. When the D input of the associated latch 220 receives an enabling "1" bit input, the NAND gate 242 also receives the same enabling "1" bit input, passing an enabling "0" bit signal to a NAND gate 244 to set a new chord memory 246. The output of the new chord memory 246 enables a timing circuit 248, producing an output coupled to the clear C inputs of all latches 220 to reset all latches 220, and hence clears the previously set latch. The $\overline{Q}$ output is toggled to produce a "0" bit at the $\overline{Q}$ output and the clear signal from circuit 248 disappears before the disappearance of the enabling D input signal, so that the newly set latch 220 remains set. The timing circuit 248 also resets the new chord memory 246, in preparation for recognition of the next new chord.

Priority logic 40 consists of a series of gates which couple, to chord output lines 42, only the lowest chord which is being played. Since the G chord has the lowest frequency of the tone generators 46 in FIG. 1A, the Q output of the latch 220 associated with the G chord is directly coupled to line 42. The Q output is also coupled to a NOR gate 252 and to a NOR gate 254. The other input of NOR 252 is coupled to the $\overline{Q}$ output of the latch 220 associated with the G # chord. The other input of NOR 254 is from the Q output of the same G # chord latch 220. The output of NOR gate 254 is inverted by a NOT gate 256 to form an input to a NOR gate 258. The other input to NOR gate 258 is the $\overline{Q}$ output of the corresponding latch.

If both the G chord and the G # chord latches 220 were enabled, the Q output of the G chord latch would prevent an output signal from passing through NSR 252. Thus, only the G chord output would be routed to the tone selection matrix. As another example, if the A chord latch 220 and G # chord latch 220 were both enabled, but the G chord latch 220 was not enabled, a pair of O's would be present to NOR gate 252, thereby generating a "1" output of line 42 associated with the G # chord. While the "O" bit from the Q output of the G chord latch would also be coupled to NOR gate 254, the other input to NOR gate 254 would be a "1" from the enabled G # latch. The resulting zero output would be negated by NOT gate 256 to produce a disabling "1" input to NOR gate 258 preventing an output from its chord line 42. Thus, the priority circuit favors the lowest chord, and only one chord output signal, from the lowest chord latch, can be passed to the tone selection matrix.

TONE SELECTION MATRIX

Figure 3:
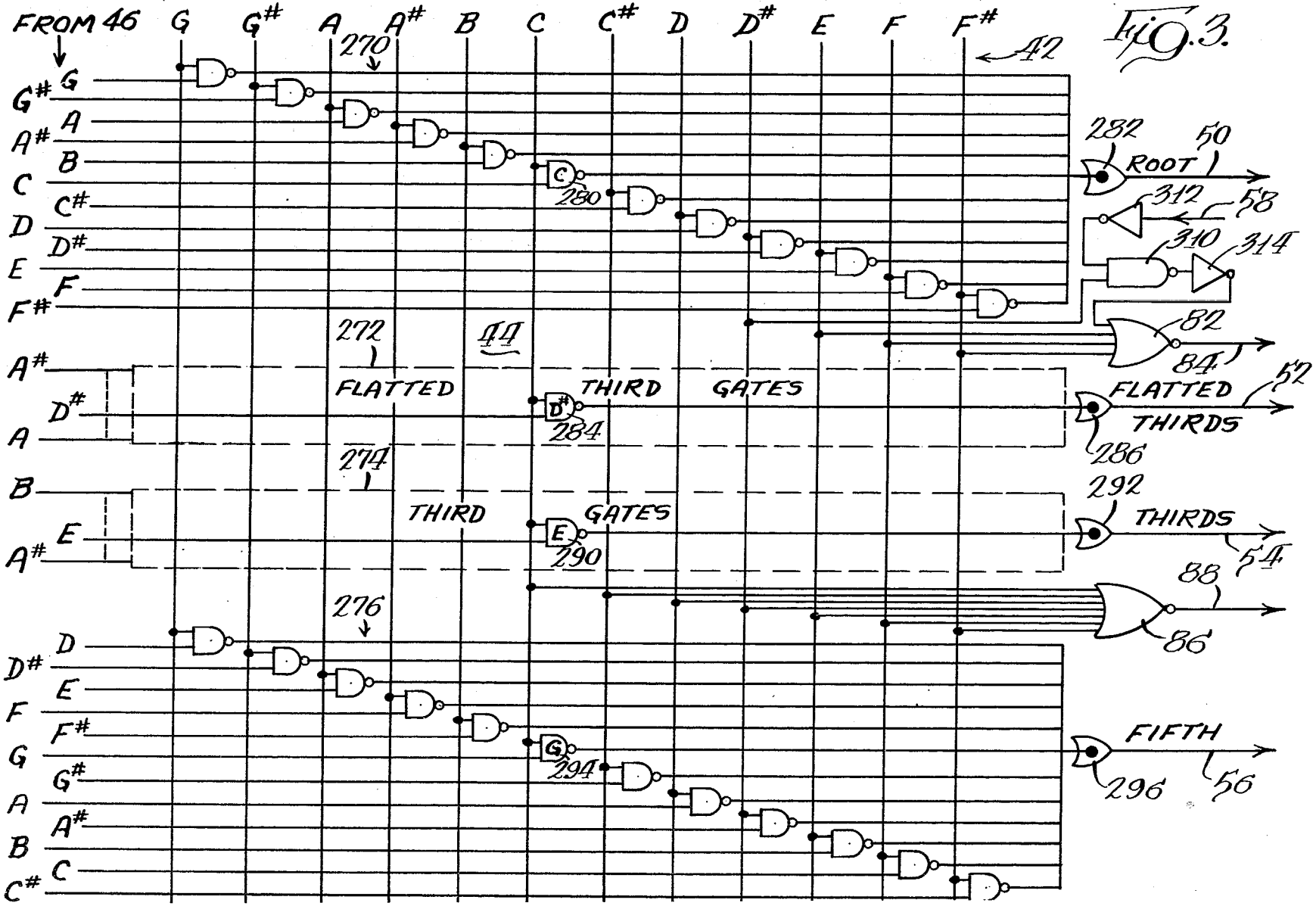
FIG. 3 is a schematic diagram of the tone selection matrix shown in block form in FIG. 1A.

In FIG. 3, the tone selection matrix 44 and the inverted chord recognition gates 82 and 86, shown in block and schematic form in FIG. 1A, are illustrated in detail. The tone signals from tone generators 46 input on the illustrated series of horizontal lines. The single chord selection signal from the chord output lines 42, input on the illustrated twelve vertical lines. Matrix 44 consists of a root selection channel 270, a flatted third selection channel 272, a third selection channel 274, and a fifth selection channel 276. If additional note intervals were to be simultaneously generated in response to a chord selection, such as a sixth note or a flatted seventh note, corresponding selection channels would be provided.

Each selection channel is similar, and interconnects a plurality of NAND gates in a manner to gate the proper tone signal to the associated output OR gate. For example, if a C chord has been selected as indicated by energization of the chord line 42 labeled C, a NAND gate 280 in the root channel 270 is enabled, thereby passing the tone signal coupled thereto, which is the C tone signal, to an OR gate 282. The C chord output line 42 also enables a NAND gate 284 in the flatted third channel 272, thereby passing a D# tone signal through an OR gate 286 to the flatted third output line 52. Also, the C chord line 42 enables a NAND gate 290 in the third channel 274, passing an E tone signal to an OR gate 292 having an output coupled to the third line 54. Finally, the C chord enables a NAND gate 294 to pass a G tone signal to an OR gate 296 for producing a G tone signal on the fifth line 56. Thus, enabling of the C chord line 42 causes simultaneous generation of the C, D #, E and G tone signals. The remaining NAND gates not shown in FIG. 3 are interconnected in order to produce the known root, third, and fifth tones associated with each chord which can be generated. As seen in FIG. 1A, either the D # or the E tone signals from OR gates 286 and 292 are then selected for passage to the third or flatted third tone output line 64 by energization of either NAND gate 66 or 60, under control of the major/minor control line 58.

Inverted chord recognition gates 82 and 86 are formed by NOR gates connected as illustrated in FIG. 3. The NOR gate 82 has inputs respectively from the E, F, and F # chord output lines 42. In addition, the D # chord output line 42 is coupled to a NAND gate 310 which has as its other input a negated signal, due to NOT gate 312, from the major/minor control line 58. The presence of appropriate signals produces a zero output which is negated by NOT gate 314 to produce an enabling input to NOR gate 82. This is utiized because the D # minor chord is inverted while the D # major chord is not. Thus, the presence of the indicated chords generates an output signal on line 84.

The fifth tone inverted recognition gate 86 has inputs respectively coupled to the C through F # chord output lines 42. The presence of any of these chords will cause an output signal to be generated on line 88.

In addition to the illustrated channels, additional channels may be provided for other note intervals which are to be played in response to selection of a particular chord, as indicated by its root tone. While standard third and fifth tone intervals have been used in the matrix, it will be appreciated that non-standard note intervals could of course be wired into the matrix in order to produce non-conventional chords. Other changes and modifications will be apparent to those skilled in the art.

Having described the invention, the embodiments of the invention in which an exclusive property or privilege is claimed are defined as follows:

1. An electrical musical instrument having a plurality of tone generators for respectively generating a plurality of tone signals, in which the improvement comprises the combination of:

chord selection means for developing chord signals each representative of a chord composed of a different plurality of selected tone signals, said chord selection means having a separate output line for each one of said chord signals, priority logic means connected to said output lines and responsive to selection of more than one chord for disabling all but one of the chord output lines from developing a chord signal; and a tone selection matrix responsive to said chord signals for passing the plurality of tone signals from the tone generators respectively associated with said chord signals, the tone selection matrix including a plurality of gates, each of said gates coupled to only one of said tone generators and responsive to only one of said chord signals to pass the tone signal from the generator connected thereto and each of said chord signals causing all of those gates connected with tone generators which generate tone signals of the chord represented thereby to pass said tone signals.

2. The instrument of claim 1 wherein the tone selection matrix has a root channel which passes a selected tone signal to a root output line to thereby form a root tone signal, and at least two interval channels which pass selected tone signals to at least two interval output lines to thereby supply at least two interval tone signals, each of the chord output lines controlling selection in the root channel and the interval channels, and including control signal generating means to develop a series of control signals, and gating means for selectively passing the tone signals on the root and interval output lines in response to the control signals.

3. The instrument of claim 1 wherein the chord selection means comprises a set of keys and a chord memory and wherein the plurality of tone generators generate tone signals having ascending frequencies, the priority logic means being connected to the chord memory to select as the single chord output signal the chord signal which has the lowest frequency.

4. The electrical musical instrument of claim 3 wherein said chord selection means includes chord detection logic having a plurality of gates connected with and each receiving input signals from a plurality of key switches selectable by an operator, said gates normally producing a chord signal only when receiving input signals from all of the switches associated therewith;

switch means for selecting a special chord mode; and, a circuit responsive to selection of said special chord mode for simulating to said gates input signals from at least one of the associated switches, said chord detection logic being enabled by said simulation to produce a chord signal in response to signals from less than all of the switches normally necessary to produce a chord signal.

5. The instrument of claim 4 wherein the chord selection means also includes a minor or major chord memory for indicating selection of aminor or major chord, and gating means coupled to the chord detection logic for actuating the memory in response to selection of switches which represent said minor or major chord, and said tone selection matrix includes means responsive to the selection indicated by the memory for selectively disabling generation of tone signals on one of a plurality of outputs thereof.

6. The instrument of claim 1 wherein the chord selection means includes a plurality of chord memories, and the priority logic means includes blocking gates having inputs coupled with at least some of the chord memories, whereby actuation of two or more chord memories causes disabling of the chord signal from the lowest priority chord memories.

7. The instrument of claim 1 wherein the chord selection means includes a tone selection means comprising a plurality of individually actuatable tone switches for selecting said combination of tones and chord detection logic coupled to the plurality of tone switches for recognizing the presence of unique chords in response to selection of unique combinations of tones corresponding thereto, and a chord memory actuated in response to recognition of said chords by the chord detection logic for producing corresponding tone signals.

8. The instrument of claim 7 wherein the chord selection means further includes a single finger recognition gate for enabling said detection logic to recognize a chord in response to selection of only one of the combination of tones corresponding thereto and a manually operable switch for actuating said single finger recognition gate, said actuated single finger recognition gate enabling the detection logic to respond to selection of only a single tone.

* * * * *